United States Patent [19]

Iijima et al.

[11] Patent Number: 4,580,119

[45] Date of Patent: Apr. 1, 1986

[54] ANISTROPIC CONFIGURATION MAGNET

[75] Inventors: Kenzaburo Iijima; Toshiharu Hoshi; Kazumoto Asano; Yoshinori Hayashi, all of Shizuoka, Japan

[73] Assignee: Nippon Gakki Seizo Kabushiki Kaisha, Japan

[21] Appl. No.: 496,814

[22] Filed: May 23, 1983

[30] Foreign Application Priority Data

May 25, 1982 [JP] Japan ..... 57-88464

[51] Int. Cl.[4] ..... H01F 7/00

[52] U.S. Cl. ..... 335/296; 335/231; 148/101; 148/108

[58] Field of Search ..... 335/296, 302, 303, 231; 148/101, 102, 103, 108

[56] References Cited

U.S. PATENT DOCUMENTS 1,976,230 10/1934 Kato et al. ..... 335/231 X
3,971,054 7/1976 Jasinski ..... 335/231 X

FOREIGN PATENT DOCUMENTS 35-17352 11/1960 Japan ..... 335/231

*Primary Examiner*—George Harris
*Attorney, Agent, or Firm*—Lerner, David, Littenberg Krumholz & Mentlik

[57] ABSTRACT

Mono-directional magnetic anisotropy given to a Fe-Cr-Co straight tube by initial heat magnetization is converted into radial magnetic anisotropy by subsequent formation of one or more flange sections through plastic deformation which is perpetuated by final age-hardening in order to obtain an excellent configuration magnet well suited for electro-acoustic converters.

4 Claims, 16 Drawing Figures

ANISTROPIC CONFIGURATION MAGNET

BACKGROUND OF THE INVENTION

The present invention relates to a configuration magnet and a method for producing the same, and more particularly relates an improvement in the construction and method of producing a configuration magnet most advantageously used for electroacoustic converters such as loud-speakers and telephone receivers.

In construction of an electro-acoustic converter such as a loud-speaker or a telephone receiver, a conductive or permiable mobile element such as a voice coil has to be surrounded by a magnetic circuit.

Such a magnetic circuit is in general formed by a cylindrical permanent magnet properly bonded to a soft steel magnetic conductor, such as a yoke or a pole, which is shaped into a magnetic circuit. The soft steel used for this purpose, however, is not a good magnetic conductor. In addition, in terms of magnetic operation, the bond layer between the permanent magnet and the magnetic conductor acts as a mere open space and hampers the operation of the permanent magnet. In order to avoid such problems, it is ideal to form most parts of the magnetic circuit by a permanent magnet which has magnetic anisotropy substantially parallel to the extension of the circuit.

Several types of configuration magnets have already been proposed in order to meet this requirement for excellent magnetic circuits. In one example, application of radial magnetization is employed in a process for forming a configuration magnet by compaction and sintering of ferrite magnet powder. The configuration magnet produced by this process, however, does not possess satisfactory radial magnetic anisotropy. In another example, a configuration magnet is obtained by cutting a block of magnet, but this process does not develop radial magnetic anisotropy over the entire plate surface of the product.

As a result of intense study on production of a configuration magnet with ideal radial magnetic anisotropy, the inventors of the present invention realized that the above-described requirement can well be met by making use of high plastic workability of Fe-Cr-Co alloy in production of such a configuration magnet.

It is already known to the public by disclosure in, for example, Japanese Patent Publication No. Sho. 57-10166 to produce a high quality magnet with monodirectional magnetic anisotropy from Fe-Cr-Co alloy by the combination of solution treatment, magnetization, cold working or warm working at a temperature 100° C. lower than the curie point, and age-hardening.

The inventors of the present invention have further advanced from this conventional proposal for use of Fe-Cr-Co alloy and tried to make use of the very fact that Fe-Cr-Co alloys have high plastic workability corresponding to that of pure iron before application of age-hardening.

SUMMARY OF THE INVENTION

It is one object to provide a configuration magnet which has radial magnetic anisotropy in a direction substantially parallel to the extension of its plastically deformed, i.e. flange, section.

It is another object of the present invention to provide an economic and efficient method for producing such a configuration magnet.

In accordance with one aspect of the present invention, the configuration magnet comprises a main body made of Fe-Cr-Co alloy and at least a part of the main body is formed into a flange section which substantially radially extends outwards from the center axis of the main body. The configuration magnet is further provided with radial magnetic anisotropy in a direction substantilly parallel to the extension of the flange section.

In accordance with another aspect of the present invention for production of such a configuration magnet, a straight tube made of Fe-Cr-Co alloy is heat treated under magnetization in its axial direction. Thereafter, at least a part, in general an axial end, of the straight tube is deformed into a flange section substantially radially extending outwards from the center axis of the straight tube. Finally, age-hardening is applied to the straight tube including the flange section.

DESCRIPTION OF THE PREFERRED EMBODIMENTS

Figure 1A:
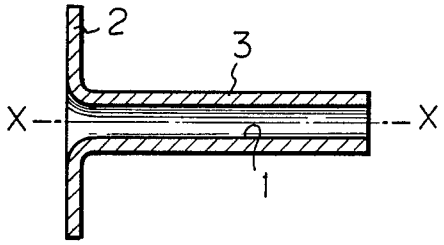
FIGS. 1A and 1B are side sectional and end views of the first embodiment of the configuration magnet in accordance with the present invention.
Figure 1B:
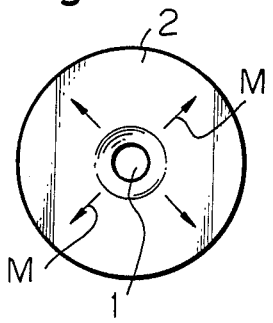

One embodiment of the configuration magnet in accordance with the present invention is shown in FIGS. 1A and 1B, in which the main body of the configuration magnet made of Fe-Cr-Co alloy includes a straight tubular section 3 having a center axial bore 1 and a flange section 2 formed at one end of the tubular section 3. The flange section 2 extends radially outwards from the center axis X of the main body and, in this case, the inner peripheral end of the flange section 2 merges in the one axial end of the tubular section 3. As indicated with "M" in FIG. 1B, the main body of the configuration magnet has radial magnetic anisotropy in directions substantially parallel to the extension of the flange section 2. The other end of the tubular section 3 may also be formed into a like flange section.

Figure 2A:
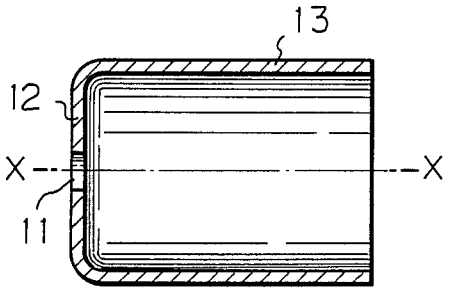
FIGS. 2A and 2B are side sectional and end views of the second embodiment of the configuration magnet in accordance with the present invention.
Figure 2B:
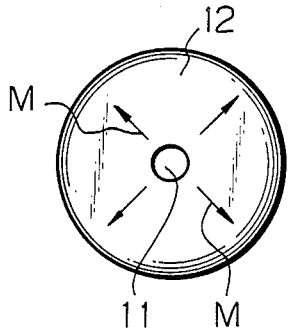

Another embodiment of the configuration magnet in accordance with the present invention is shown in FIGS. 2A and 2B, in which the main body of the configuration magnet made of Fe-Cr-Co alloy includes a straight tubular section 13 and a flange section 12 formed at one end of the tubular section 13 and having a center axial bore 11. The flange section 12 extends radially outwards from the center axis X of the main body and, in this case, the outer peripheral end of the flange section 12 merges in the one axial end of the tubular section 13. As indicated with "M" in FIG. 2B, the main body of the configuration magnet has radial magnetic anisotropy in directions substantially parallel to the extension of the flange section 12. The other end of the tubular section 13 may also be formed into a like flange section.

Figure 3A:
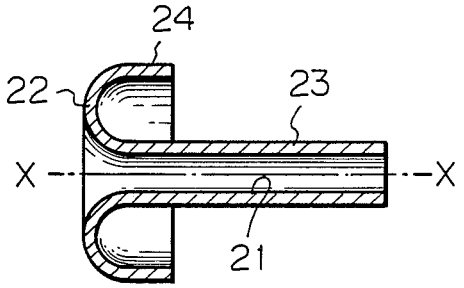
FIGS. 3A and 3B are side sectional and end views of the third embodiment of the configuration magnet in accordance with the present invention.
Figure 3B:
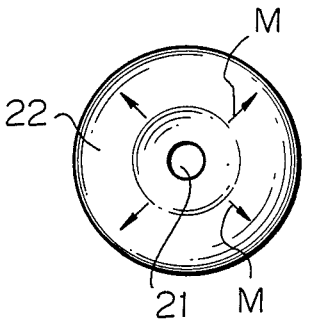

In the case of the foregoing embodiments, the flange sections 2 and 12 extend in planes substantially normal to the center axis X of the associated tubular sections 3 and 13. However, the configuration magnet in accordance with the present invention is not limited to this construction only. The other embodiment of the configuration magnet in accordance with the present invention is shown in FIGS. 3A and 3B, in which the main body of the configuration magnet made of Fe-Cr-Co alloy includes a straight tubular section 23 having a center axial bore 21 and a flange section 22 formed at one end of the tubular sections 23. The flange section 22 extends radially outwards from the center axis X of the main body and, like the first embodiment shown in FIGS. 1A and 1B, the inner peripheral end of the flange section 22 merges in the one axial end of the tubular section 23. In addition, the outer peripheral end of the flange section 22 merges in a fold-back 24 which extends substantially in parallel to the tubular section 23 towards the other end of the tubular section. As indicated with "M" in FIG. 3B, the main body of the configuration magnet again has radial magnetic anisotropy in directions substantially parallel to the extension of the flange section 22. The other end of the tubular section 23 may be formed into either a like flange section or a flange section like the one possessed by the first embodiment shown in FIGS. 1A and 1B.

Figure 4A:
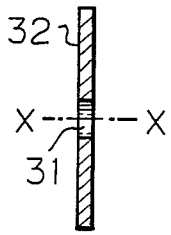
FIGS. 4A and 4B are side sectional and end views of the fourth embodiment of the configuration magnet in accordance with the present invention.
Figure 4B:
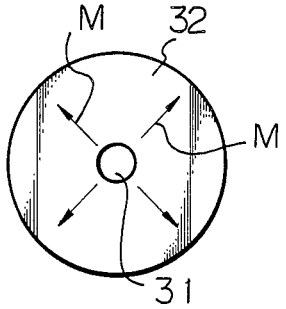

In the case of the foregoing embodiments, the main body of the configuration magnet includes a tubular section 3, 13 or 23, However, the configuration magnet in accordance with the present invention is not limited to this construction only. The other embodiment of the configuration magnet in accordance with the present invention is shown in FIGS. 4A and 4B, in which the main body of the configuration magnet made of Fe-Cr-Co alloy includes a flange section 32 having a center axial bore 31. The flange section 32 extends radially outwards from the center axis X of the main body. As indicated with "M" in FIG. 4B, the main body of the configuration magnet again has radial magnetic anisotropy in directions substantially parallel to the extension of the flange section 32.

As is clear from the foregoing description, in any embodiment, the configuration magnet in accordance with the present invention is characterized by provision of at least one flange section extending radially outwards from the center axis of its main body and possession of radial magnetic anisotropy in directions substantially parallel to the extension of such a flange section. Possession of such magnetic anisotropy is in particular advantageous to formation of the magnetic circuits in electro-acoustic converters.

Although circular flange sections are shown in the drawings, flange sections of oval or polygonal profiles may also be used for the configuration magnet in accordance with the present invention.

The configuration magnet in accordance with the present invention may be made of Fe-Cr-Co alloy of any known compositions. In one typical example, the alloy may contain 2 to 30% by weight of Cr, 5 to 37% by weight of Co and remaining amount being Fe. It may further contain, in total 0.1 to 8% by weight of one or more components taken from a group consisting of Ti, Zr, Ni, V and Si, if required.

Production of the above-described configuration magnet in accordance with the present invention starts from formation of a straight tube made of Fe-Cr-Co alloy. This process advantageously makes use of the high plastic workability of Fe-Cr-Co alloys. Most simply, the straight tube is formed by drawing or extrusion. Thanks to the high plastic workability of Fe-Cr-Co alloy, such processes are well employable with admissible percent work. In another process, a plate is curved to form a tubular body and mating edges are joined, for example, by tight welding. The higher the percent work at this stage of the production, the more excellent the magnetic characteristics of the resultant configuration magnet. In terms of percent work, formation of the straight tube by flat plate rolling is most recommended. This process in general includes melt casting, hot forging, annealing, cold rolling and solution treatment as is well known to the public. A flat plate obtained by this process has a thickness in a range from 0.2 to 5 mm.

Next, the straight tube so prepared is subjected to heat treatment under magnetization in its axial direction. Process conditions for the heat treatment varies depending on the composition of the Fe-Cr-Co alloy used for the straight tube. In one example, the straight tube is heated at a temperature from 670° to 720° C. for about one hour, slowly cooled down to a temperature from 600° to 620° C. at a rate of 10° to 90° descent per hour, and subsquently subjected to abrupt cooling. Magnetization is carried out at an intensity of 16,000 to 400,000 A/m, which may somewhat impare plastic workability of Fe-Cr-Co alloys but not to such an extent to disable the subsequent plastic deformation of the straight tube.

Next, plastic deformation is applied to the straight tube in order to form at least a part of it into a flange section such as shown in FIGS. 1A to 4B. This plastic deformation is carried out by either warm or cold working on a spinning machine. The warm working is carried out preferably at a temperature from 400° to 500° C. The maximum percent work at the end of the straight tube is in a range from $\frac{1}{4}$ to 5 percent. Taking the construction shown in FIG. 1A for example, the percent work used here refers to the ratio in diameter of the flange section 2 with respect to the tubular section 3.

The plastically deformed straight tube is then subjected to age-hardenihg which significantly improves the magnetic characteristics whilst maintaining the radial magnetic anisotropy developed in the preceding process. More specifically, the plastically deformed straight tube is subjected to heat treatment in which the temperature lowers gradually in a range from 620° to 500° in a period from 10 to 30 hours. Since this age hardening greatly impairs the plastic workability of Fe-Cr-Co alloys, the above-described plastic deformation should precede the age-hardening.

As described already, the configuration magnet produced in accordance with the present invention possesses radial magnetic anisotropy in directions parallel to the extension of the plastically deformed section, i.e. the flange section or sections, and, consequently, is advantageously used for electro-acoustic converters such as loud-speakers and telephone receiver since it provides an ideal magnetic drive circuit for their voice coils. However, usage of the configuration magnet in accordance with the present invention is not limited to these exemplified applications. Same can be advantageously usable for any electric appliances which require presence of radial magnetic anisotropy in directions substantially parallel to the extension of the plastically deformed, i.e. flange, section or sections.

EXAMPLE

Example 1

A flat plate of about 3 mm. thickness was prepared from an Fe-Cr-Co alloy which contained 25.0% by weight of Cr, 12.0% by weight of Co, 0.5% by weight of Ti and residual amount of Fe by combination of melt casting, hot forging, hot rolling, annealing and cold rolling. Solution treatment was applied to the flat plate by heating at 950° C. for 0.5 hours and, right after, cooling by water. The flat plate was then curved into a hollow cylindrical form and mating edges were united together by tight welding using Ar as the inert gas in order to obtain a straight tube of 20 mm outer diameter, 17 mm inner diameter and 1000 mm length.

The straight tube so obtained was heated at 700° C. for 1 hour under magnetization in the axial direction at 80,000 A/M, cooled down to 610° at a rate of 50° C. per hour, and finally subjected to abrupt cooling.

One end of the tube was plastically deformed outwards at 500° C. on a spinning machine in order to obtain a material configuration magnet such as the one shown in FIGS. 1A and 1B. The outer diameter of the flange section was 52 mm and the length of the tubular section was 23 mm.

Next the material configuation magnet was heated at 620° C. for 1 hour, cooled down to 500° C. at a rate of 10° C. per hour and subjected to age hardening, in which the material was furnace cooled after being maintained at 500° C. for 1 hour, in order to obtain the configuration magnet in accordance with the present invention.

Figure 5A:
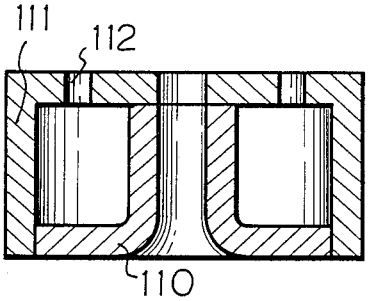
FIGS. 5A and 5B are side sectional and plan views of a magnetic drive circuit, incorporating the configuration magnet in accordance with the present invention, used for a compact speaker voice coil.
Figure 5B:
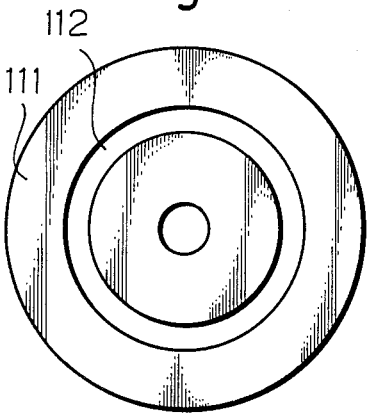

The configuration magnet 110 so obtained was bonded to a hollow cylindrical magnetic conductor 111 (soft steel) in order to obtain a magnetic drive circuit for a compact speaker voice coil shown in FIGS. 5A and 5B. The conductor 111 had a circular slot 112 of 1.0 mm width for mounting of the voice coil in its closed axial end section.

For comparison, a pole-type alnico magnet 113 of 10 mm diameter was bonded to a hollow cylindrical magnetic conductor 111*a* in order to obtain a conventional magnetic drive circuit having a circular slot 112 in one of its closed axial end sections.

The particulars and characteristics of those magnetic drive circuits are shown in the following Table.

Figure 6A:
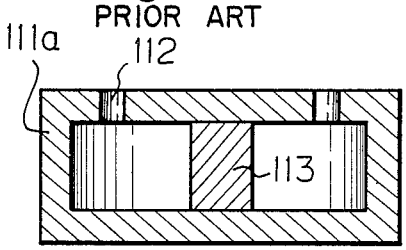
Fig. 6A PRIOR ART
FIGS. 6A and 6B are side sectional and plan views of a magnetic drive circuit, incorporating the conventional rod magnet, used for a compact speaker voice coil.
Figure 6B:
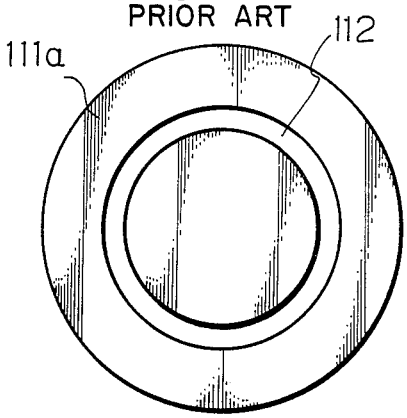
Fig. 6B PRIOR ART

| Type | Magnetic drive circuit Cross sectional surface ($mm^2$) | Length (mm) | Gap magnetic flux density Bg (T) |
|---|---|---|---|
| Conventional (FIG. 6) | 180 | 19.6 | 1.2 |
| present invention (FIG. 5) | 94.2 | 37.5 | 1.33 |

The data in the table clearly indicate that the magnetic drive circuit incorporating the configuration magnet in accordance with the present invention has a large permeance coefficient, and a gap magnetic flux density larger than that of the magnetic drive circuit incorporating the conventional magnet.

Example 2

Figure 8A:
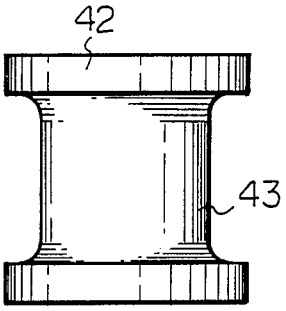
FIGS. 8A and 8B are side sectional and plan views of a rotor magnet, incorporating the configuration magnet in accordance with the present invention, used for step motors.
Figure 8B:
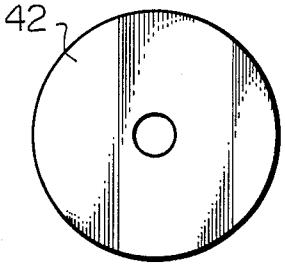

A rotor magnet for step motors shown in FIGS. 8A and 8B was formed from a configuration magnet in accordance with the present invention. The configuration magnet used here was a modification of the one shown in FIGS. 1A and 1B and had two flange sections 42 formed at both axial end of a tubular section 43. The outer diameter of the flange sections 42 was 29 mm and the length of the tubular section 43 was 19 mm. The weight of the configuration magnet was about 65 g.

Figure 7A:
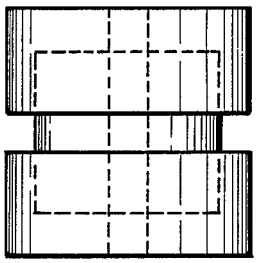
Fig. 7A PRIOR ART
FIGS. 7A and 7B are side sectional and plan views of a conventional rotor magnet used for step motors.
Figure 7B:
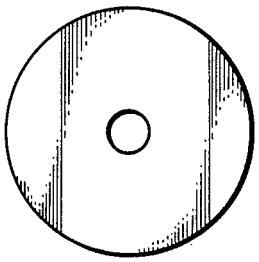
Fig. 7B PRIOR ART

For comparison, a rotor magnet for step motors shown in FIGS. 7A and 7B was formed from a conventional magnet which was axially sandwitched by a pair of hollow cylindrical bodies made of iron. The outer diameter of the cylindrical bodies was 29 mm, the outer diameter of the magnet was 25 mm and the length of the magnet was 18 mm. The weight of the magnet was about 65 g and that of the iron bodies was about 62 g.

The property of a rotary magnet for step motors is usually evaluated in terms of Figure of Merit $Wo^2 = Tm/Jo \cdot \theta o$ in which Tm; Torque in Kg·cm at $\theta o$ displacement.

$\theta o$; Displacement (step angle) in radian.

Jo; Inertia moment in $Kg \cdot cm^2$.

The Figure of merit ($Wo^2$) was 597 for the rotor magnet shown in FIGS. 7A and 7B and 1415 for the rotor magnet shown in FIGS. 8A and 8B. The data obtained clearly indicated that use of the configuration magnet in accordance with the present invention assures reduced weight and high response of the rotor magnet.

It will be well understood that not only the construction shown in FIGS. 1A and 1B but also those shown in FIGS. 2A to 4B and their modifications are all suited for use for the magnetic drive circuit shown in FIG. 5 and the rotor magnet shown in FIGS. 7A and 7B.

We claim:

1. A configuration magnet comprising a tubular section made of Fe-Cr-Co alloy having a center axis and being magnetically anisotropic in the direction of said center axis; and a flange section formed at one axial end of said tubular section and extending substantially radially from said center axis, said flange section being magnetically anisotropic in radial directions substantially parallel to said flange section.

2. A configuration magnet as claimed in claim 1 in which said flange section extends radially outwardly from said one axial end of said tubular section.

3. A configuration magnet as claimed in claim 2 in which the outer peripheral end of said flange section is folded back into a cylinder which is coaxial with said center axis.

4. A configuration magnet as claimed in claim 1 in which said flange section extends radially inwardly from said one axial end of said tubular section.

* * * * *